United States Patent [19]

Sameshima et al.

[11] Patent Number: 4,620,827

[45] Date of Patent: Nov. 4, 1986

[54] APPARATUS FOR SUPPLYING FLAT SHEETS SUCH AS PULP SHEETS

[75] Inventors: Tadanori Sameshima, Fuji; Akito Kakigi, Fujinomiya, both of Japan

[73] Assignee: Honshu Seishi Kabushiki Kaisha, Tokyo, Japan

[21] Appl. No.: 683,197

[22] Filed: Dec. 18, 1984

[30] Foreign Application Priority Data

Dec. 26, 1983 [JP] Japan ..... 58-249466

[51] Int. Cl.[4] ..... B65H 3/32

[52] U.S. Cl. ..... 414/114; 271/128; 414/119; 29/239

[58] Field of Search ..... 414/114, 115, 117, 118, 414/119; 271/42, 128, 130; 221/238; 29/239; 254/104

[56] References Cited

U.S. PATENT DOCUMENTS

| | | | |
|---|---|---|---|
| 3,055,516 | 9/1962 | Mead | 414/114 |
| 3,083,963 | 4/1963 | Bardy | 414/118 X |
| 3,095,193 | 6/1963 | Sorenson | 271/42 |
| 3,826,348 | 7/1974 | Preisig et al. | 414/114 X |
| 3,966,059 | 6/1976 | Sase | 414/114 |

FOREIGN PATENT DOCUMENTS

| | | | |
|---|---|---|---|
| 55-140442 | 11/1980 | Japan | 271/128 |
| 827360 | 5/1981 | U.S.S.R. | 414/117 |
| 927699 | 5/1982 | U.S.S.R. | 271/42 |

*Primary Examiner*—Leslie J. Paperner

*Attorney, Agent, or Firm*—Wenderoth, Lind & Ponack

[57] ABSTRACT

An apparatus is provided for supplying for a subsequent process step a desired number of flat sheets at one time from a pile of flat sheets such as pulp sheets or the like. The pile is put on a platform which is elevated step by step by a given amount corresponding to a desired number of sheets. A gap is first formed in the pile by inserting one wedge member which is provided so as to be reciprocatingly movable in the transverse direction with respect to the pile. By also inserting in the gap fork tines provided so as to be likewise reciprocatingly movable in the transverse direction with respect to the pile, the flat sheets on and over the fork tines are assuredly separated from the others. At the same time these upper sheets are sent to a feed mechanism by virtue of the engagement of stopping members which are movable integrally with the fork tines in association with the forward movement of the fork tines and the edge portions of the flat sheets.

3 Claims, 8 Drawing Figures

APPARATUS FOR SUPPLYING FLAT SHEETS SUCH AS PULP SHEETS

BACKGROUND OF THE INVENTION

1. Field of the Invention

The present invention relates to an apparatus for supplying flat sheets such as pulp sheets or the like and, more particularly, to such an apparatus which is capable of carrying a desired number of flat sheets at a time from a pile of flat plates such as pulp sheets or the like for the next step in a process.

2. Description of the Prior Art

An apparatus has been known in which, in order to take out flat sheets one by one from a pile of flat sheets and then to carry each sheet to a roll type feed mechanism for delivery to the next step in a process, the flat sheets are collected one by one by means of a sucking force by virtue of a vacuum from the top of a vertically placed pile or from the outermost side of a horizontally placed pile and this sheet is thence carried to the roll type feed mechanism.

However, in such a vacuum type apparatus, the suction function of the suction device is not performed in a desirable manner in a case where the deformation of flat sheets is large; on the other hand, if the sticking force between the flat sheets is large, a few sheets will be carried at a time, causing a variation in the number of sheets delivered. Pulp sheets are one kind of such flat sheets wherein the deformation phenomenon exists and the sticking force between the flat sheets is large. The pulp sheets are produced by forming pulp into sheets like cardboard and a desired number of such sheets are supplied at a time to a defiberizing machine in a manufacturing or similar process relating to a non-woven fabric which is produced in a method in which the pulp sheets are defiberized and the fibers thus obtained are deposited and fixed. A constant number of these pulp sheets are piled (this pile is called a bale) and this bale is wrapped by a large pulp sheet and then bound by wiring material such as wire or the like. A proper number of these bales are put together and bound similarly by wiring material such as wire or the like. In general, at present, the combined batch of bales is carried in such a bound state. Deformation is therefore large at those portions where the wiring material is in contact with the bales, so that the suction device of the carrying apparatus cannot function in a desirable manner which could also lead to a case where it is necessary to supply the flat sheets to the feed mechanism manually, one by one, especially with regard to a few sheets at the outside portion of each bale. Further, since pulp contains a large amount of water, the sticking force caused when the pulp sheets are pressed against each other is large. Consequently, even when it is intended to deliver the pulp sheets one by one by means of the suction device, several sheets can be lifted up at a time and supplied to the feed mechanism, causing a risk of variation on the number of sheets supplied in the next process step.

Moreover, although in terms of working efficiency it is often desirable, depending on the field of application, to carry a few sheets at a time, the number of sheets that can be constantly carried is limited to one in the vacuum type carrying apparatus, so that it is impossible to improve the working efficiency.

SUMMARY OF THE INVENTION

It is an object of the present invention to provide a plate supplying apparatus which can assuredly separate a preselected number of flat sheets from a remaining number of the same and can repeatedly carry them without resorting to the use of a process for collecting them by means of a sucking force created by virtue of a vacuum source.

In the present invention, to accomplish the above object, a pile consisting of flat sheets is vertically placed on a platform and this platform is elevated step by step in correspondence with the desired number of flat sheets. On the other hand, by inserting a single wedge member which is provided so as to be reciprocatingly movable in the transverse direction with respect to the pile, a gap is first formed in the pile. Also by inserting in the gap fork tines which are provided so as to be likewise reciprocatingly movable in the transverse direction with respect to the pile, the flat sheets on and over the fork tines are assuredly separated from the others. At the same time the flat sheets on and over the fork tines are carried to the feed mechanism by virtue of the engagement of stopping members which are movable integrally with the fork tines in association with the forward movement of the fork tines and the edge portions of the flat sheets.

DETAILED DESCRIPTION OF THE PREFERRED EMBODIMENT

Figure 1:
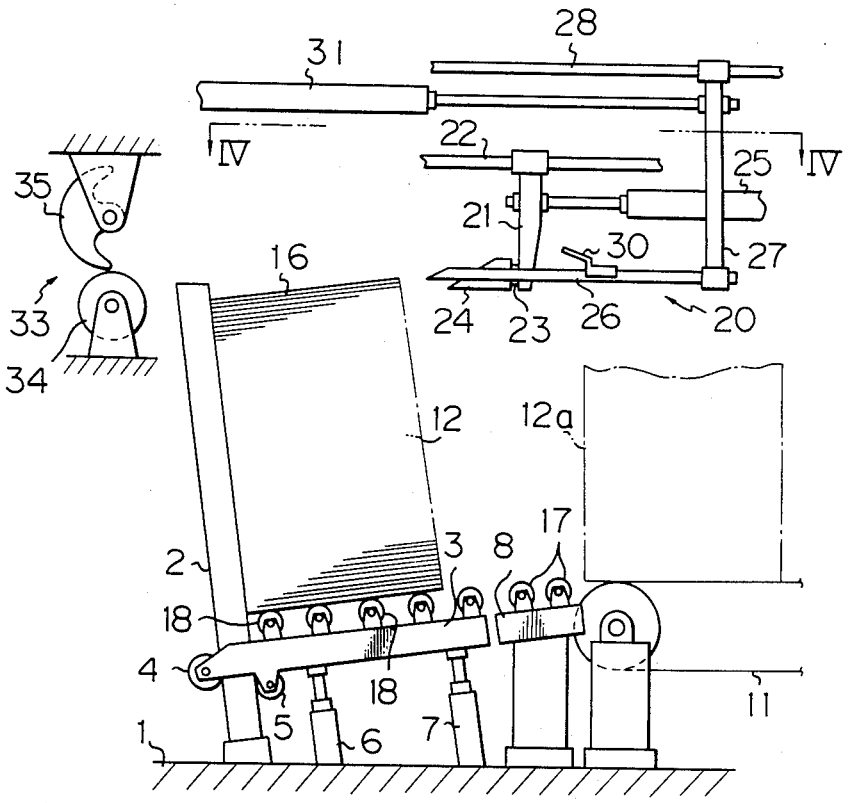
FIG. 1 is a side elevational view of a flat sheet supplying apparatus according to the present invention.

FIG. 1 is a side elevational view of a flat sheet supplying apparatus according to one embodiment of the present invention, in which a reference numberal 1 denotes a base. A post 2 is fixed to the base 1 so as to be slightly inclined with respect to the vertical direction as shown in the drawing. A platform 3 is supported from the post 2 through rollers 4 and 5. The rollers 4 and 5 support the platform 3 so that it can be moved up and down along the post in such a state that the platform is held perpendicularly to the post. The platform can be vertically moved by hydraulic cylinders 6 and 7 and this elevational motion is performed step by step by a preselected distance. This dimension may be set to any desired value. An apparatus for performing the step movement by a constant amount as described above is well known.

Figure 2:
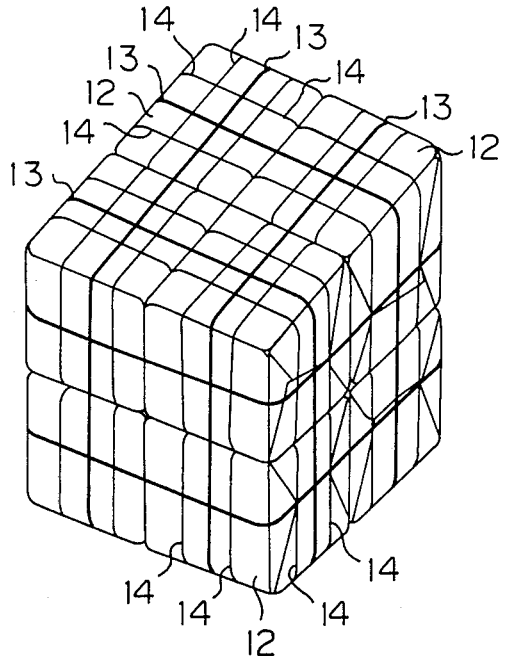
FIG. 2 is a perspective view illustrating bales consisting of pulp sheets as an example of flat sheets, in which the bales have been bound together for transportation.
Figure 3:
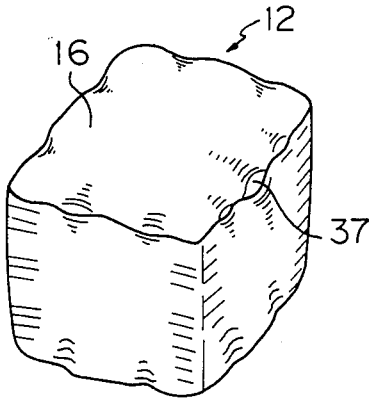
FIG. 3 is a perspective view of one bale of pulp sheets.
Figure 4:
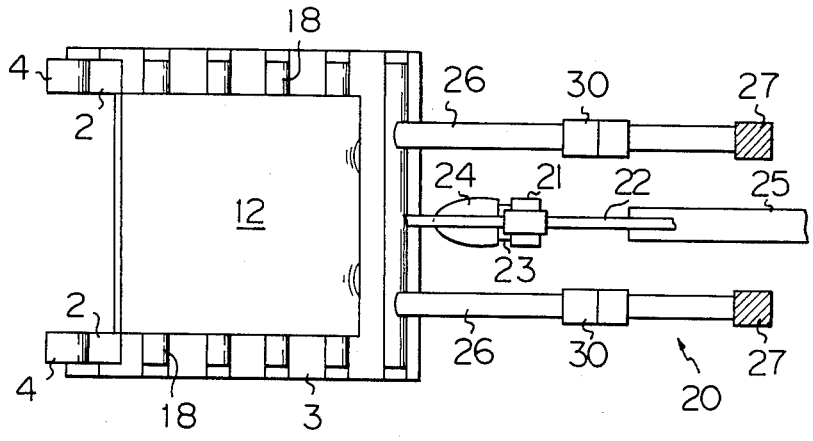
FIG. 4 is a plan view taken along the line IV—IV in FIG. 1.

An intermediate conveyor 8 is provided adjacent to the platform 3 and a bale conveyor 11 is provided adjacent to the intermediate conveyor. The bale which is carried by the bale conveyer is obtained in the following manner. That is, as shown in FIG. 2, a plurality of bales 12 each of which is wrapped by a large pulp sheet and is bound by thin wires 14 are combined together by means of thick wires 13. The bales 12 are sent in this combined state and are unpacked prior to each bale being put on the conveyer 11. After being unpacked, it is inevitable that each bale 12 is significantly depressed at the positions of the wires, as shown in FIG. 3. Thus, each pulp sheet 16 loses its flat state. On the other hand, the pulp sheets 16 are strongly adhered to each other at the positions of the wires since they are strongly forced into contact with each other.

The bales 12 which were unpacked as mentioned above are sequentially placed on the conveyer 11 and are sent to a location (indicated at 12*a*) adjacent to the intermediate conveyer. At this location, the presence of the bales 12 is detected by a photoelectric device (not shown), thereby stopping the conveyer 11. When the platform is returned to the location shown in FIG. 1 after all of the pulp sheets 16 on and over the platform 3 have been completely moved, the conveyer 11 starts its motion, thereby moving the next bale 12*a* to a location indicated at 12 in FIG. 1 through the intermediate conveyer 8 and rollers 17 and 18 of the platform 3. In the case where the intermediate conveyer 8 and platform 3 are inclined, as shown in the drawing, all of the rollers 17 and 18 can be used as idle rollers. However, in the case where they are arranged horizontally, at least some of the rollers are driving rollers or, alternatively, an apparatus for pushing the bale 12 is provided independently of the rollers.

A wedge supporting member 21 is provided above the platform 3 so as to be slidable along a guide bar 22 for the wedge. A wedge member 24 is attached at the bottom end of the supporting member 21 through an elastic member 23. Although the elastic member is made of rubber in this embodiment, any elastic member such as metal spring or the like may be used. The wedge supporting member 21 can be reciprocatingly moved to the right and left in FIG. 1 by an air cylinder 25. Fork tines 26 serving as parts of a conveying apparatus 20 are arranged on both sides of the wedge member 24. These fork tines are fixed to fork tine supporting members 27. The supporting members 27 are slidable along guide bars 28 for the fork tines. The fork tine supporting members 27 can be likewise reciprocatingly moved to the right and left in FIG. 1 by an air cylinder 31. The conveying apparatus 20 further has stopping members 30 fixed to the top of each fork tine. These stopping members engage the edge portions of the pulp sheets 16 and thereby the sheets are moved.

Figure 5:
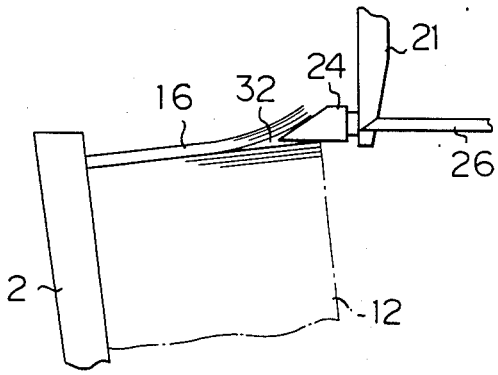
FIG. 5 is a side elevational view of a bale and a wedge member illustrated to explain the motion of the wedge member.

In operation, first the air cylinder 25 is extended from the state shown in FIG. 1, so that the wedge member 24 is inserted into the bale 12 as shown in FIG. 5, thereby forming a gap 32. The height of the bales relative to the wedge member is determined in a such manner that the number of pulp sheets 16 on and over the wedge member 24 becomes a predetermined number. When the wedge member stops at the location shown in FIG. 5, the air cylinder 31 contracts and the fork tines 26 are inserted into the gap 32. The upper pulp sheets are separated from the others in association with the forward movement of the fork tines 26. When the tines 26 move further forward, the stopping members 30 come into engagement with the edge portions of the pulp sheets, thereby causing the upper pulp sheets to be conveyed to a feed mechanism 33 in response to the movement of the fork tines 26. (Refer to FIG. 6).

Figure 6:
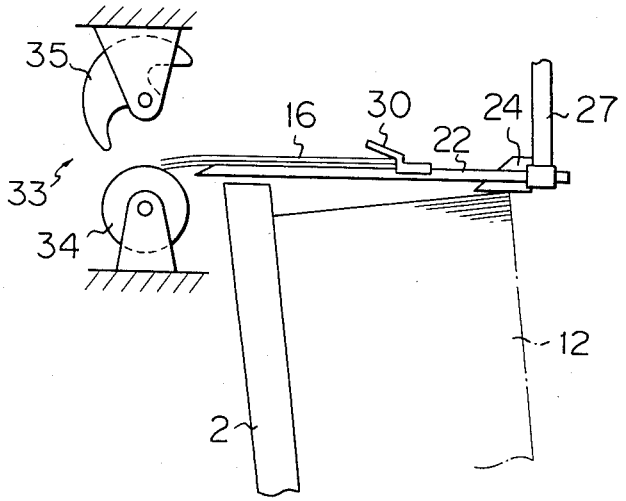
FIG. 6 is a side elevational view of a fork tine, bale and feed mechanism to explain the motion of the fork tine.

The feed mechanism includes a roller 34 and a fan-like rotary member 35 which are rotated synchronously with each other. After the fan-like rotary member 35 rotates until it provides a space between the roller 34 and the rotary member 35, as shown in FIG. 6, the pulp sheets 16 are sent therebetween. When the fan-like rotary member further rotates from this state, the pulp sheets 16 are sandwiched between the roller 34 and the rotary member 35, thereby causing the sheets 16 to be sent to the next process step. When the pulp sheets are carried by the feed mechanism, the wedge member 24 and fork tines 26 are returned to their original positions, and the platform 3 is then elevated by a predetermined amount only, corresponding to a desired number of pulp sheets. Thereafter, the above-described steps are repeated.

Figure 7:
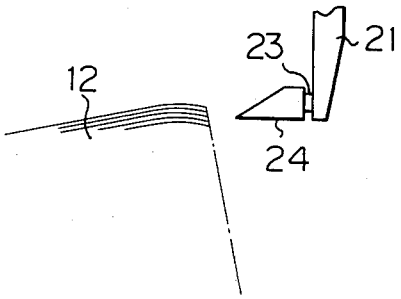
FIGS. 7 and 8 are side elevational views illustrating the relationship between the wedge member and a bale having pulp sheets which are inwardly bent at the outer edge portion.
Figure 8:
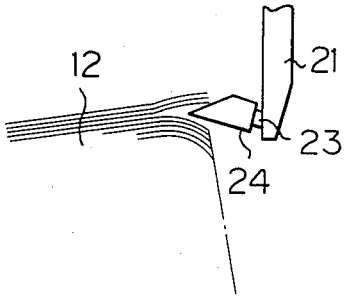

Although the post 2 may be vertically provided, in many cases the outer edge portions of the pulp sheets have been inwardly bent in the bales as shown in FIG. 7 due to force applied during packing or transportation; therefore, if the post 2 is inclined to make the bales slant in such a case, the wedge member 24 can be easily inserted. Further, on the other hand, even in the case of pulp sheets being extremely bent, if the wedge member 24 can elastically swing through the elastic member 23, as shown in the example of FIG. 8, the wedge member can be displaced along the surface of the sheet just under the wedge member; consequently, this makes it possible to prevent the wedge member from penetrating into the pulp sheets thereunder. This effect can be also derived by attaching the overall mechanism including the air cylinder and rod 22 in such a manner that it can be elastically displaced with respect to the supporting members supporting such mechanism.

If the transverse location of the wedge member is fixed, it is possible to adjust the location and direction of the bales 12 to prevent the wedge member 24 from reaching the large concave portions 37 of the bales, which would cause an error regarding the number of sheets which should be sent if it occurred. However, the transverse location of the wedge member may be made variable and the optimum location of the wedge member may be obtained for every bale whatever the size.

As described above, after a gap is formed between the pulp sheets by the single wedge member, the fork tines are inserted into the gap, so that the two fork tines cannot enter the spaces between sheets which are different from each other; thus, a predetermined number of sheets can be assuredly conveyed at one time. In addition, this predetermined number of sheets may be easily varied by merely changing the elevation of the platform step by step.

What is claimed is:

1. An apparatus for supplying flat sheets comprising:

a platform for substantially vertically supporting a pile of a plurality of flat sheets;

means for elevating said platform step by step by a predetermined amount at one time;

a single wedge member provided so as to be reciprocatingly movable in the transverse direction with respect to said pile;

conveying means having fork tines which are arranged on both sides of said wedge member and are provided so as to be reciprocatingly movable in the transverse direction with respect to said pile and stopping members which are movable integrally with said fork tines; and feed means for sending the flat sheets which are carried by said conveying means to the next process step;

wherein said fork tines are inserted into a gap formed by inserting said wedge member into said pile, said fork tines are moved further forward in order to allow said stopping members to come into engagement with edge portions of said flat sheets, thereby conveying the flat sheets on said fork tines to said feed means.

2. An apparatus according to claim 1, further comprising a supporting member, and an elastic member on said supporting member on which said wedge member is supported and normally positioned at substantially the midpoint of its range of resilient movement.

3. An apparatus according to claim 1, wherein said platform comprises means for supporting said pile in an inclined position with respect to the direction perpendicular to the direction of the reciprocating motion of said wedge member.

* * * * *